US007278545B2

(12) United States Patent
Costin et al.

(10) Patent No.: US 7,278,545 B2
(45) Date of Patent: Oct. 9, 2007

(54) INTERCHANGEABLE FITMENT APPARATUS AND SYSTEM

(75) Inventors: Sonny Costin, Windermere, FL (US); Joseph R. Russo, Jr., Rumson, NJ (US); Tim Kelly, Schwenksville, PA (US); Antonio LeBron, Spring Hill, FL (US)

(73) Assignee: CHEP Technology Pty Limited, Sydney (AU)

( * ) Notice: Subject to any disclaimer, the term of this patent is extended or adjusted under 35 U.S.C. 154(b) by 0 days.

(21) Appl. No.: 10/091,610

(22) Filed: Mar. 5, 2002

(65) Prior Publication Data

US 2003/0168481 A1 Sep. 11, 2003

(51) Int. Cl.
*B65D 88/00* (2006.01)

(52) U.S. Cl. ..... 220/1.6; 220/495.05; 222/105

(58) Field of Classification Search ..... 229/117.3; 220/495.01, 495.03, 495.05, 495.06, 1.6, 220/403; 222/105
See application file for complete search history.

(56) References Cited

U.S. PATENT DOCUMENTS 2,721,674 A * 10/1955 Lazard ..... 220/62.21
3,226,002 A * 12/1965 Walker ..... 229/117.3
3,918,605 A * 11/1975 Butler ..... 220/495.06
4,560,085 A * 12/1985 vom Hofe et al. ..... 220/495.08
4,635,814 A * 1/1987 Jones ..... 220/495.05
4,930,661 A * 6/1990 Voorhies ..... 206/386
4,934,654 A * 6/1990 Glass et al. ..... 310/90.5
5,046,634 A * 9/1991 McFarlin et al. ..... 53/457
5,217,138 A * 6/1993 Nichols ..... 220/495.06

* cited by examiner

*Primary Examiner*—Anthony D. Stashick
*Assistant Examiner*—Harry A Grosso
(74) *Attorney, Agent, or Firm*—Allen, Dyer, Doppelt, Milbrath & Gilchrist, P.A.

(57) ABSTRACT

The invention concerns a fitment apparatus which includes: a flange having first opening; at least one projection assembly containing at least one second opening in which the projection assembly is attached to the flange such that said first opening and said second opening form a channel; and at least one engagement structure mounted on the projection assembly for detachably securing the fitment apparatus to an interface. The invention also concerns an interchangeable fitment system which includes: a container; and an interface detachably engaged to the container in which the interface has a notch having predetermined dimensions for receiving a first fitment apparatus and a second fitment apparatus. The first and second fitment apparatuses each have an opening corresponding to the predetermined dimensions in which the perimeter of the opening of the second fitment apparatus is not equal to the perimeter of the opening of the first fitment apparatus.

6 Claims, 7 Drawing Sheets

INTERCHANGEABLE FITMENT APPARATUS AND SYSTEM

CROSS-REFERENCE TO RELATED APPLICATIONS (Not applicable)

STATEMENT REGARDING FEDERALLY SPONSORED RESEARCH OR DEVELOPMENT (Not applicable)

BACKGROUND

1. Technical Field

The present invention relates generally to shipping containers, and more particularly to a fitment apparatus and system for use in such containers.

2. Description of Related Art

Currently, many companies use shipping containers to transport a wide variety of cargo. Notably, a large number of these containers are used to haul fluids. Some of the containers that are used to haul fluids use a durable, inner plastic liner bag as the primary means of fluid containment. Once the cargo reaches its final destination, it must be drained from the shipping container and the plastic bag in which it is stored. As such, the containers used to transport fluid cargo generally contain one or more drainage mechanisms to permit the contents to be drained.

Conventional draining mechanisms typically consist of a fitment and a mechanical securing device for securing the fitment to the shipping container. The fitment usually includes a flange and a threaded female outlet for receiving a threaded male valve that can be attached to a drainage hose or pipe. The mechanical securing device is usually integral to the container and is often sized to receive a fitment of a specific dimension.

The present system, however, suffers from several significant drawbacks. Notably, there is no uniform standard in the shipping industry for mechanical securing devices to secure fitments. Consequently, if a user desires to place a three inch threaded opening fitment in draining mechanism, then the selected container needs to include a securing mechanical device that is able to accommodate a three inch fitment. If the user wishes to switch to a two inch threaded fitment, then it will be necessary to select a container with a mechanical securing device that is able to accommodate a two inch fitment.

The mechanical securing devices used in containers are often able to accommodate either a two inch or three inch fitment but not both sizes. However, even when a container has a mechanical securing device that can accommodate two and three inch fitments, the requirement for containers to include a mechanical securing device complicates container design and adds to manufacturing costs. Further, the mechanical securing devices can jam thereby preventing the fitment form being properly secured. The mechanical securing devices can also capture particles of food or dirt, which can contaminate perishable cargo during the shipping and unloading stages. Thus, what is needed in the art is a new fitment system that can eliminate the need for mechanical securing devices for securing fitments within containers.

SUMMARY OF THE INVENTION

The present invention concerns a fitment apparatus which includes: a flange having a first opening; at least one projection assembly containing at least one second opening in which the projection assembly is attached to the flange such that the first opening and the second opening form a channel; and at least one engagement structure mounted on the projection assembly for detachably securing the fitment apparatus to a container interface. The engagement structure can be a detent or a spring-loaded snap. In one arrangement, the projection assembly can contain a projection for receiving a fluid flow device and at least one support rib. In addition, the flange can contain a midpoint, and the second opening of the projection assembly can have a center, and the center of the second opening can be located below the midpoint of the flange.

The fitment apparatus can also include a protrusion in which the protrusion can be attached to the flange and can extend outwardly away from the flange to a first point. Further, the projection assembly can include a projection in which the projection can be attached to the flange and can extend outwardly away from the flange to a second point. In addition, the first point and the second point can be substantially in the same vertical plane.

The present invention also concerns an interchangeable fitment system which includes: a container; and an interface detachably engaged to the container in which the interface has a notch having predetermined dimensions for receiving a first fitment apparatus and a second fitment apparatus. The first fitment apparatus has an opening corresponding to the predetermined dimensions, and the second fitment apparatus has an opening corresponding to the predetermined dimensions in which the perimeter of the opening of the second fitment apparatus is not equal to the perimeter of the opening of the first fitment apparatus.

In one arrangement of the above system, the first fitment apparatus can include: a flange; at least one projection assembly in which the projection assembly can be attached to the flange; and at least one engagement structure, which can be mounted on the projection assembly, for detachably securing the first fitment apparatus to the interface. Further, the second fitment apparatus can include: a flange; at least one projection assembly in which the projection assembly can be attached to the flange; and at least one engagement structure, which can be mounted on the projection assembly for detachably securing the second fitment apparatus to the interface.

The present invention also concerns a method of providing a fitment apparatus which includes the steps of: providing a flange having a first opening; providing at least one projection assembly having at least one second opening; attaching the projection assembly to the flange such that said first opening and said second opening form a channel; and mounting at least one engagement structure on the projection assembly for detachably securing the fitment apparatus to a container interface. In the above method, the engagement structure can be a detent or a spring-loaded snap. Also, the projection assembly can contain a projection for receiving a fluid flow device and at least one support rib. In another aspect, the flange can contain a midpoint, and the second opening of the projection assembly can contain a center, and the attaching step can further include the step of attaching the projection assembly to the flange such that the center of the second opening of the projection assembly is located below the midpoint of the flange.

The method can further include the steps of providing a protrusion and attaching the protrusion to the flange such that the protrusion can extend outwardly away from the flange to a first point. In addition, the projection assembly can include a projection, and the method can further include the step of attaching the projection to the flange such that the projection can extend outwardly away from the flange to a second point. Also, the first point and the second point can be substantially in the same vertical plane.

The invention also concerns a method of providing an interchangeable fitment system including the steps of: providing a container; providing an interface which has a notch having predetermined dimensions; detachably securing the interface to the container; providing a first fitment apparatus having an opening corresponding to the predetermined dimensions; providing a second fitment apparatus having an opening corresponding to the predetermined dimensions in which the perimeter of the opening of the second fitment apparatus is not equal to the perimeter of the opening of the first fitment apparatus; and interchangeably connecting the first fitment apparatus and the second fitment apparatus to the interface.

In one arrangement of the above method, the providing a first fitment apparatus step can further include the steps of: providing a flange; providing at least one projection assembly; attaching the projection assembly to the flange; and mounting at least one engagement structure on the projection assembly for detachably securing the first fitment apparatus to the interface. Moreover, the providing a second fitment apparatus step can further include the steps of: providing a flange; providing at least one projection assembly; attaching the projection assembly to the flange; and mounting at least one engagement structure on the projection assembly for detachably securing the second fitment apparatus to the interface.

DETAILED DESCRIPTION OF THE PREFERRED EMBODIMENTS

Figure 1:
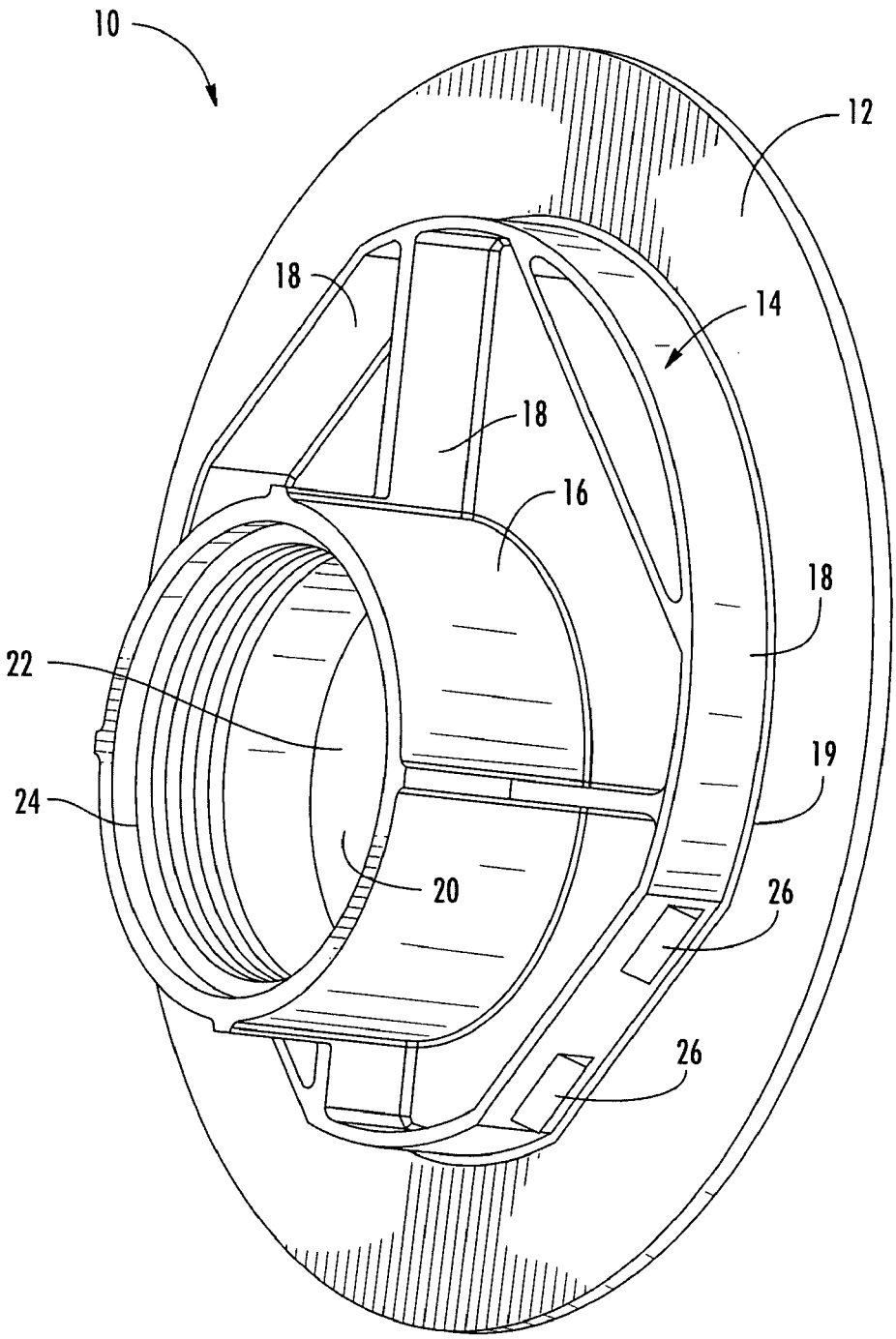
FIG. 1 is a perspective drawing of a fitment apparatus in accordance with the inventive arrangements.

Referring to FIG. 1, a fitment apparatus 10 is shown. The fitment apparatus 10 can include a flange 12 and a projection assembly 14. Although the fitment apparatus 10 is shown as having one projection assembly 14, the invention is not so limited, as the fitment apparatus 10 can contain any number of projection assemblies 14. The projection assembly 14 can include a projection 16 and one or more support ribs 18. While FIG. 1 illustrates the projection 16 as having a circular shape, the projection 16 is not limited to such a configuration, as the projection 16 can be any other suitable shape. In addition, the flange 12 is not limited to a substantially circular disk configuration as pictured in FIG. 1, as the flange 12 can have any other suitable configuration. Alternatively, the flange 12 can be comprised of one or more support beams extending substantially horizontally, substantially vertically or at any other suitable angle across the projection assembly 14.

The projection 16 can also include one or more openings 20. Although not pictured, the flange 12 can also include an opening. As a result, the projection assembly 14 can be attached to the flange 12 such that the opening 20 of the projection 16 can be placed over the opening in the flange 12 to create a channel 22 through which a wide variety of suitable materials may flow. Although the opening in the flange 12 and the opening 20 in the projection 16 can have the same dimensions such that the channel 22 that is created by such a union has a uniform perimeter, the channel 22 is not so limited; the opening in the flange 12 and the opening 20 in the projection 16 can both be any suitable shape or size. Moreover, the shape of the opening 20 in the projection 16 is not limited to the shape of the projection 16 in which it sits.

In one arrangement, the inner surface of the projection 16 can include one or more threads 24 for detachably engaging an appropriately-sized opening of a fluid flow device such as a hose or pipe. Placing the threads 24 on the inner surface of the projection 16 can permit the projection 16 to engage the male couplings of the fluid flow device. In an alternative arrangement, the threads 24 can be placed on the outer surface of the projection 16 thereby enabling the projection 16 to engage the female coupling of an appropriate fluid flow device. In another alternative arrangement, one or more latches for detachably engaging an appropriate fluid flow device can be mounted on either the inner or outer surfaces of the projection 16.

The support ribs 18 can be attached to the flange 12 and the projection 16 thereby providing extra support to the projection 16. It should be noted that the support ribs 18 are not limited to the particular configuration shown in FIG. 1, as any number of support ribs 18 can be placed on the flange 12 in any other suitable pattern. In one arrangement, the fitment apparatus 10 can include an outer support rib 18 defining an outer perimeter 19 of the projection assembly 14. As will be explained below, this type of design can permit the fitment apparatus 10 to be received by a loading/unloading interface.

Figure 2:
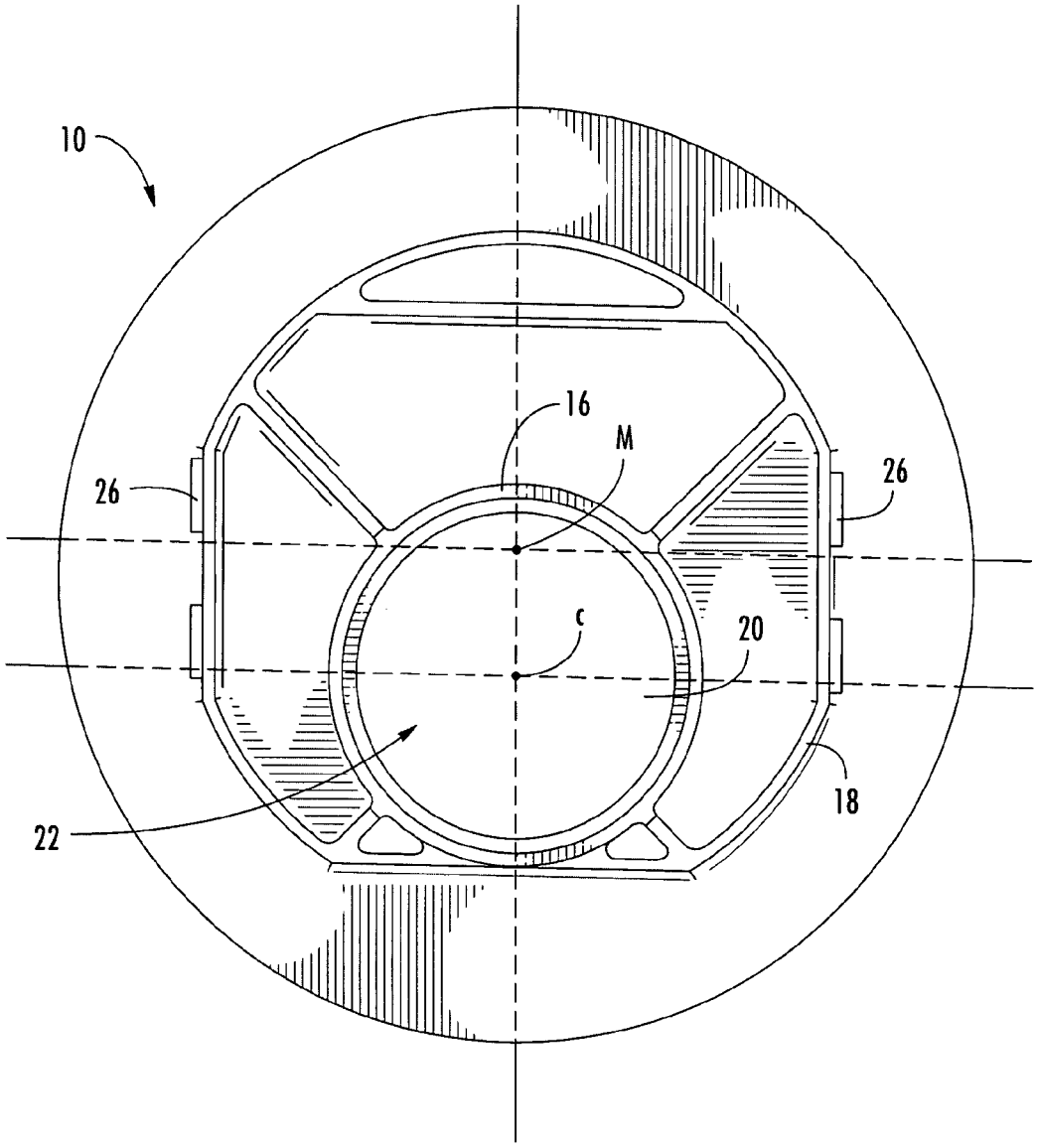
FIG. 2 is a frontal view of the fitment apparatus of FIG. 1.
Figure 3:
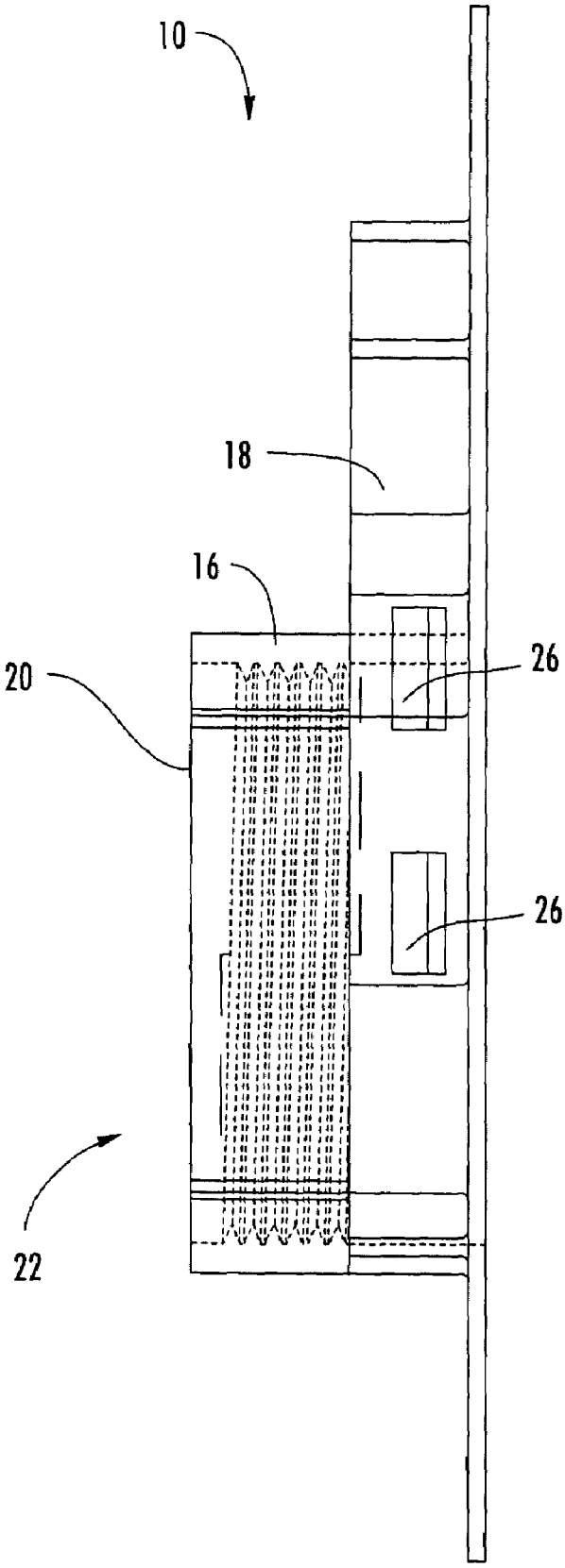
FIG. 3 is a side view of the fitment apparatus of FIG. 1.

As shown in FIGS. 1-3, the fitment apparatus 10 can also include one or more engaging structures 26. The engaging structures 26 can enable the fitment apparatus 10 to be detachably secured to a loading/unloading interface (not pictured). Once the fitment apparatus 10 is secured to a suitable loading/unloading interface, the engaging structures 26 can hold the fitment apparatus 10 in place as a fluid flow device is coupled to or decoupled from the fitment apparatus 10 and as material passes through the channel 22. Since the engaging structures 26 can permit the fitment apparatus 10 to be secured to a loading/unloading interface, the present invention can eliminate the need for a receiving container (to which the fitment apparatus 10 can be coupled) to have its own mechanical securing device for securing the fitment apparatus 10 along with the inherent disadvantages associated with the mechanical securing device. In one arrangement, the engaging structures 26 can be detents or spring-loaded snaps; however, the engaging structures 26 are not limited to any particular structure, as the engaging structures 26 can be any suitable device or structure for securing the fitment apparatus 10 to a loading/unloading interface.

As shown in FIGS. 1-3, the engaging structures 26 can be mounted on the outermost support rib 18. In addition, the outermost support rib 18 can include one or more substantially straight edges onto which the engaging structures 26 can be mounted. The invention, however, is not limited to this particular embodiment, as the engaging structures 26 can be mounted on any other suitable structure on the fitment apparatus 10. As an example, the engaging structures 26 can be mounted on the projection 16 or any other suitable support rib 18. Moreover, the engaging structures 26 are not limited to being mounted on substantially straight edges, as the engaging structures 26, for example, can be mounted on a support rib 18 having a rounded edge. In fact, the engaging structures 26 can be mounted on any suitable structure on the fitment apparatus 10 so long as the fitment apparatus 10 can be properly secured to a loading/unloading interface.

Referring to FIG. 2, the flange 12 can have a midpoint M located substantially in the geographical center of the flange 12. In addition, the opening 20 of the projection 16 can have a center C located substantially in the geographical center of the opening 20. In one arrangement, the center C of the opening 20 can be located below the midpoint M of the flange 12. Such a design can help drain a larger amount of the material flowing through the projection 16 from the container to which the fitment apparatus 10 is attached since the opening 20 can be placed at the lowest possible point on the fitment apparatus 10. It should be noted, however, that the invention is not limited in this regard, as the center C can also be located above or in substantially the same horizontal plane as the midpoint M.

Figure 4:
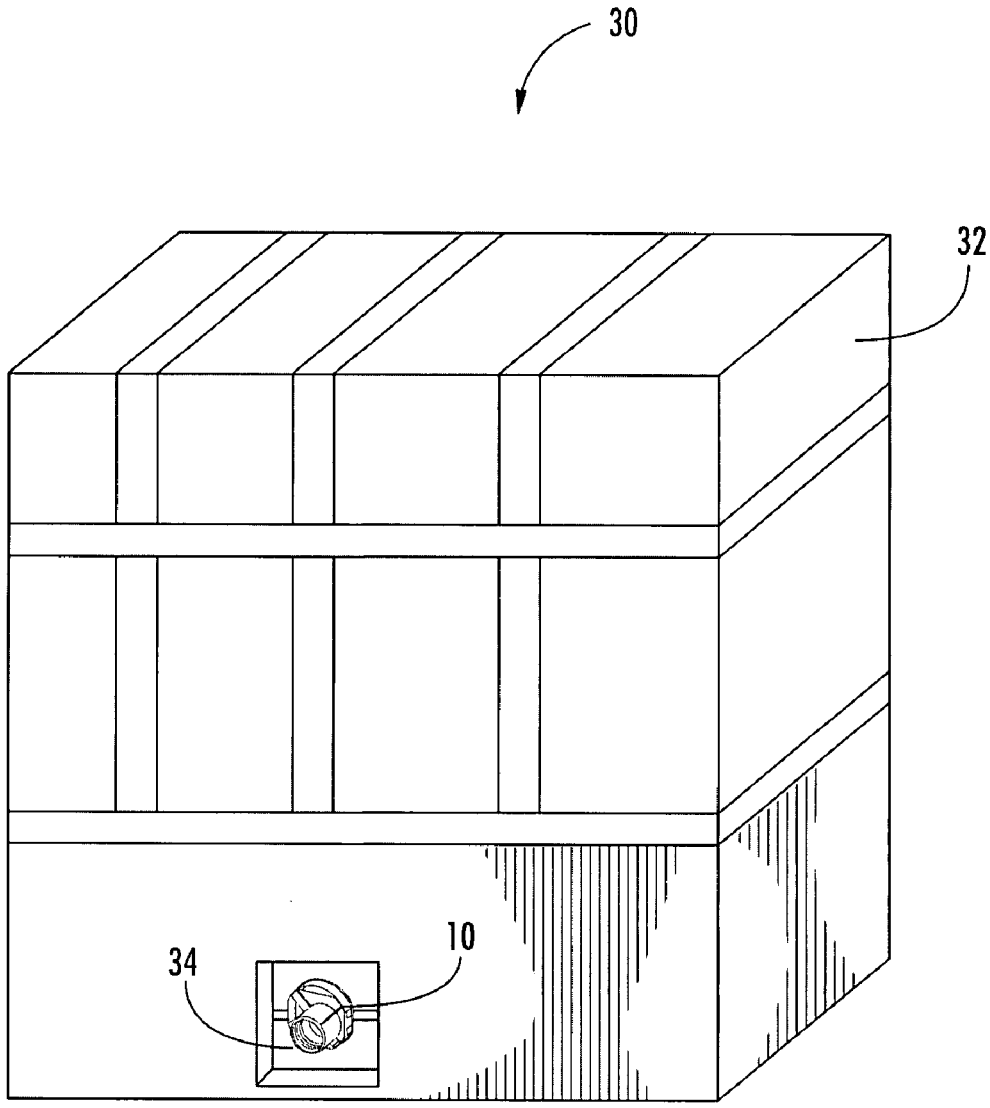
FIG. 4 is a perspective drawing of an interchangeable fitment system in accordance with the inventive arrangements.

FIG. 4 shows an interchangeable fitment system 30 in accordance with the inventive arrangements. The system 30 can include a container 32, a loading/unloading interface 34, one or more inner liner bags (not pictured) typically constructed of plastic or some other suitable material and one or more differently sized fitment apparatuses 10. In one arrangement, the inner liner bag can be placed inside the container 32 and can be filled with cargo to be shipped or stored. The container 32 can be any container suitable for shipping or storing numerous types of cargo. The interface 34 can be detachably engaged to the container 32. Although the interface 34 can be engaged to the container 32 at any suitable location, it may be desirable, for purposes of draining the container 32, to place the interface 34 at a location near the bottom of the container 32. The fitment apparatuses 10 can be attached to the inner liner bag for purposes of filling or emptying the inner liner bag. In one arrangement, the fitment apparatuses 10 can be heat sealed to the inner liner bags or attached to the inner liner bags with an adhesive; however, any other suitable means of attaching the fitment apparatuses 10 to the inner liner bags can be used.

Figure 5A:
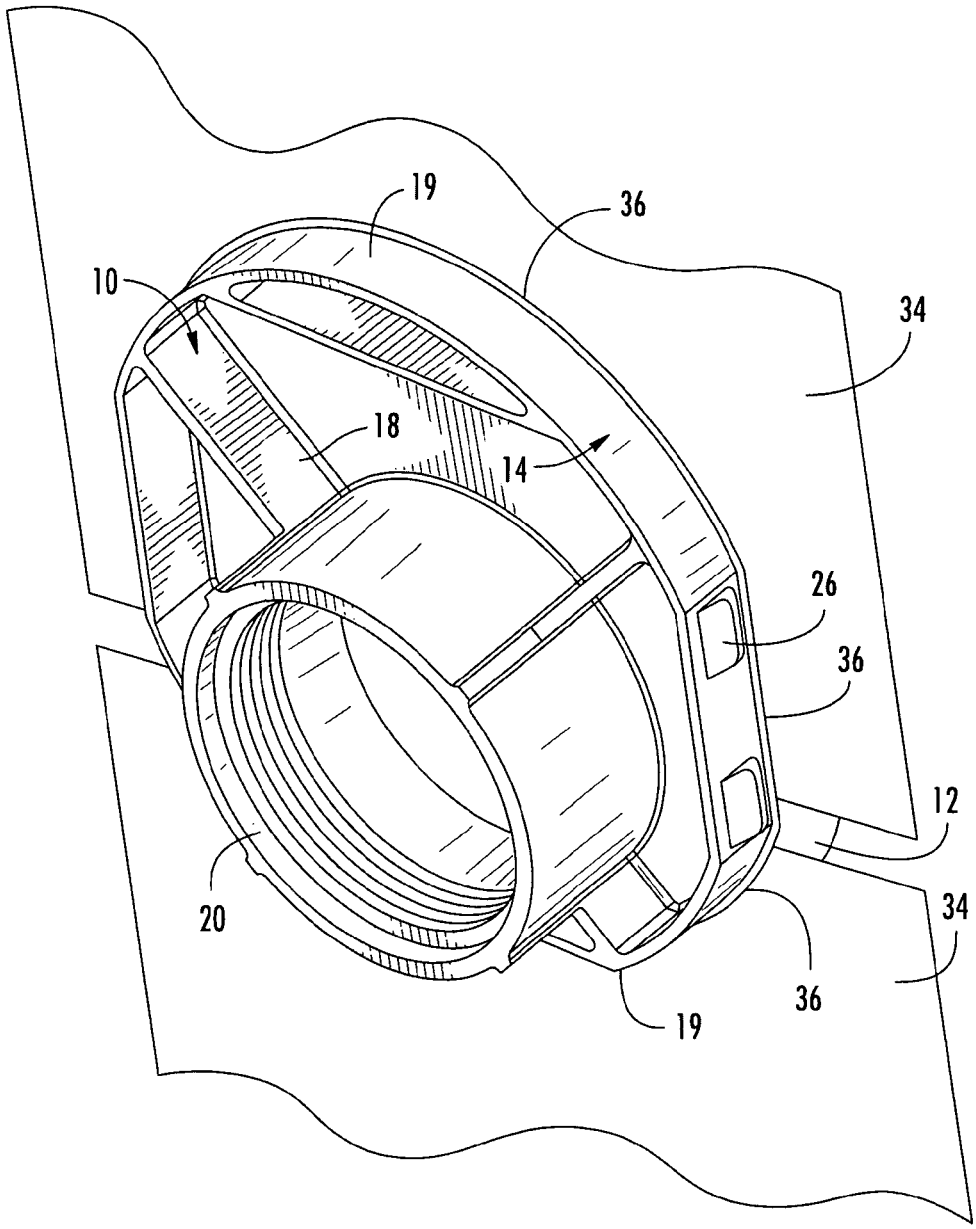
FIG. 5*a* shows a fitment apparatus engaged to an interface.
Figure 5B:
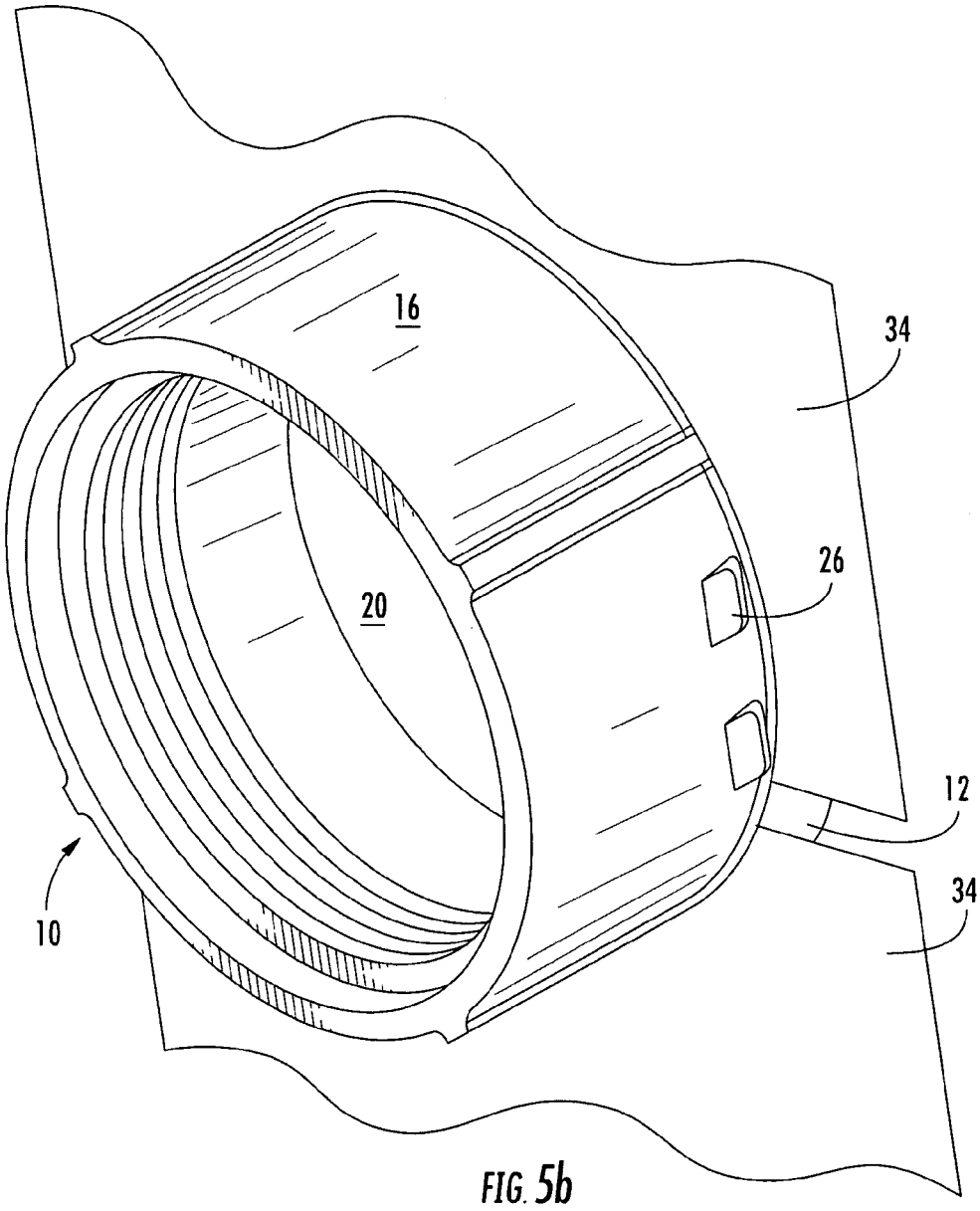
FIG. 5*b* shows an alternative fitment apparatus engaged to an interface.

FIG. 5*a* shows a closer view of the fitment apparatus 10 and the interface 34. As pictured, the interface 34 can be designed to receive the fitment apparatus 10. The interface 34 can have a notch 36 of predetermined dimensions for purposes of receiving the fitment apparatus 10. In one arrangement, the interface 34 can have a notch 36 of a predetermined size such that the notch 36 can snugly fit the outer perimeter 19 of the projection assembly 14. This embodiment can help hold the fitment apparatus 10 in place during the loading/unloading or shipping processes and can serve as a backup if one or more of the engaging structures 26 should fail or be damaged. The invention, however, is not limited in this regard, as the interface 34 can incorporate any other suitable design and the notch 36 can have any suitable dimensions for receiving the fitment apparatus 10. As an example, the interface 34 can merely engage the engaging structures 26 in order to secure the fitment apparatus 10 to the interface 34. Such an embodiment can establish even greater uniformity throughout the fitment industry, as fitment apparatuses 10 with no or relatively small outer perimeters 19 can be secured to a uniform interface 34. For instance, as shown in FIG. 5*b*, a fitment apparatus 10 with a large opening 20, no support ribs 18 and having the engaging structures 26 located on the projection 16 could be secured to the interface 34. Different fitment apparatuses 10 may be used interchangeably with the interface 34.

In operation, the projection assembly 14 of the fitment apparatus 10 can be inserted through the notch 36 of the interface 34. In the arrangement illustrated in FIG. 5*a* as the projection assembly 14 moves through the notch 36, the inner surfaces of the interface 34 can engage the engaging structures 26 and can force the engaging structures 26 towards the center of the projection assembly 14. Once the engaging structures 26 move beyond the notch 36, the engaging structures 26 can snap back into place and can engage the outer surfaces of the interface 34 thereby securing the fitment apparatus 10 to the interface 34. The flange 12 can prevent the fitment apparatus 10 from passing completely through the notch 36 of the interface 34, as the flange 12 typically extends beyond the predetermined dimensions of the notch 36. It should be noted that this is merely one example of the operation of the invention, as the engaging structures 26 can incorporate any other design capable of allowing the fitment apparatus 10 to pass through the interface 34 while at the same time securing the fitment apparatus to the interface 34 once the fitment apparatus 10 is properly received by the interface 34.

As noted earlier, the dimensions of the openings 20 of many different fitment apparatuses 10 are dissimilar. For example, many fitment apparatuses 10 contain openings 20 that are approximately two inches in diameter while many contain openings 20 that are approximately three inches in diameter. The fitment apparatuses 10 having approximately two inch openings 20 are currently designed to fit a particular mechanical securing device, and the fitment apparatuses 10 having approximately three inch openings 20 are generally designed to fit another differently-sized mechanical securing device. Therefore, many fitment apparatuses 10 have disparate outer perimeters 19. This nonuniformity leads to added costs and increased inefficiencies, as the interfaces 34 containing these mechanical securing devices must be switched for fitment apparatuses 10 of different sizes.

Since the present invention, however, eliminates the need for mechanical securing devices (through the incorporation of the engaging structures 26), the design of the outer perimeter 19 of the fitment apparatus 10 is no longer constrained by the limitations imposed by the predetermined dimensions of a notch housed by such a mechanical securing device. As such, the outer perimeter 19 can be uniform for a large number of fitment apparatuses 10. Integrating a uniform outer perimeter 19 for different fitment apparatuses 10 can permit the use of a single interface 34. This can obviate the necessity of switching interfaces 34 if the fitment apparatuses 10 must be switched.

Figure 6B:
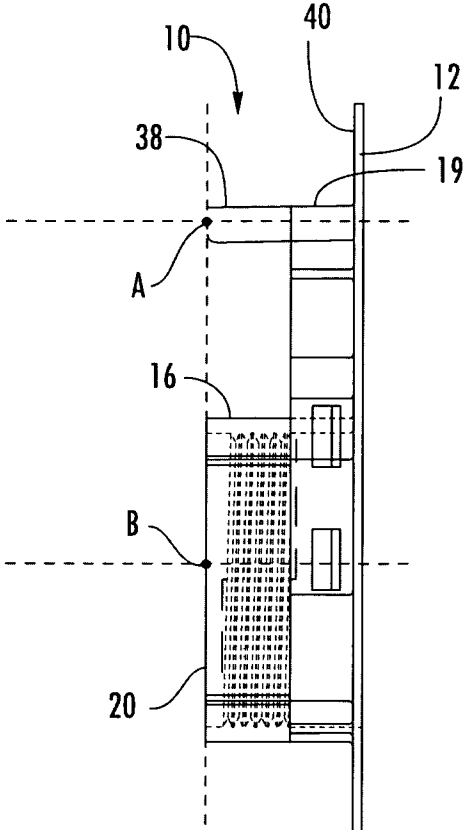
FIG. 6B shows a side view of the fitment apparatus of FIG. 6A.
Figure 6A:
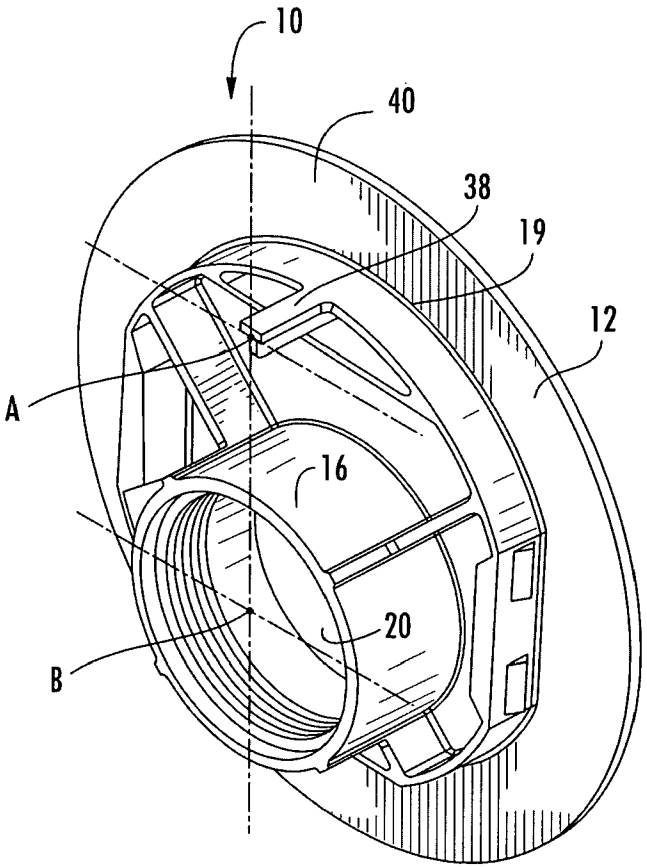
FIG. 6A shows an alternative arrangement of a fitment apparatus in accordance with the inventive arrangements.

FIGS. 6A and 6B illustrate an alternative arrangement of the fitment apparatus 10. As shown, one or more protrusions 38 can be attached to and can extend outwardly away from the fitment apparatus 10. The protrusion 3 8 can extend outwardly to a point A in which point A is the distance from the flange 12 to the end of the protrusion 38. Also, the projection 16 or at least a portion of the projection 16 can extend outwardly to a point B in which point B is the distance from the flange 12 to the end of the projection 16 or the portion of the projection 16. In one particular arrangement, point A can be in substantially the same vertical plane as point B. Although FIGS. 6A and 6B illustrate the protrusion 38 as being attached to the top center of the outer perimeter 19, it is understood that the invention is not so limited, as the protrusion 38 can be positioned on any other suitable portion of the fitment apparatus 10.

Attaching one or more of these protrusions 38 to the fitment apparatus 10 in this manner can improve a manufacturing process associated with the fitment apparatus 10 when it is part of the interchangeable fitment system 30 (not pictured in FIGS. 6A and 6B). Specifically, to attach an inner liner bag to the fitment apparatus 10, the fitment apparatus 10 is typically positioned such that the opening 20 of the projection 16 faces down. As the projection 16 may be off-center (as discussed above), the fitment apparatus 10 may have a tendency to tip such that an upper portion 40 of the fitment apparatus 10 may come into contact with the surface supporting the fitment apparatus 10. If the fitment apparatus is tilted, it may be difficult to attach an inner liner bag to the fitment apparatus 10 in an automated manner. Notably, however, the protrusion 38 can prevent the fitment apparatus 10 from tilting as the liner bag is attached to the fitment apparatus 10, particularly if point A is in substantially the same vertical plane as point B.

It should be understood the embodiments described herein are for illustrative purposes only and various modifications or changes in light thereof will be obvious to persons skilled in the art and are to be included within the spirit and purview of this application. The invention can also take other specific forms without departing from the spirit or essential attributes thereof.

What is claimed is:

1. An interchangeable fitment system, comprising:

a shipping container having an opening therein;

a first fitment apparatus and a second fitment apparatus each having equal outer perimeters; and a loading/unloading interface detachably secured to the opening in the shipping container and having a notch with dimensions corresponding to the outer perimeters for interchangeably receiving the first and second fitment apparatuses;

the first fitment apparatus comprising a flange, a first projection assembly coupled to the flange and a plurality of spring-loaded snaps spaced around the first projection assembly for detachably securing to the loading/unloading interface, the first projection assembly having an opening for interfacing with a first size fluid flow device;

the second fitment apparatus comprising a flange, a second projection assembly coupled to the flange and a plurality of spring-loaded snaps spaced around the second projection assembly for detachably securing to the loading /unloading interface, the second projection assembly having an opening for interfacing with a second size fluid flow device;

the first and second fitment apparatuses having different size openings in the first and second projection assemblies for respectively interfacing with different size fluid flow devices for loading/unloading the shipping container, the first and second fitment apparatuses being interchangeably receivable in the loading/unloading interface via the plurality of spring-loaded snaps based on selection of the first or second size fluid flow device.

2. The interchangeable fitment system according to claim 1, wherein the flange for the first fitment apparatus has an opening for forming a channel with the opening in the first projection assembly.

3. The interchangeable fitment system according to claim 1, wherein the flange for the second fitment apparatus has an opening for forming a channel with the opening in the second projection assembly.

4. A method for providing an interchangeable fitment system for a shipping container, the method comprising:

providing the shipping container with an opening therein;

providing a first fitment apparatus and a second fitment apparatus each having equal outer perimeters;

detachably securing a loading/unloading interface to the opening in the shipping container, the loading/unloading interface having a notch with dimensions corresponding to the outer perimeters for interchangeably receiving the first and second fitment apparatuses;

the first fitment apparatus comprising a flange, a first projection assembly coupled to the flange and a plurality of spring-loaded snaps spaced around the first projection assembly for detachably securing to the loading/unloading interface, the first projection assembly having an opening for interfacing with a first size fluid flow device;

the second fitment apparatus comprising a flange, a second projection assembly coupled to the flange and a plurality of spring-loaded snaps spaced around the second projection assembly for detachably securing to the loading/unloading interface, the second projection assembly having an opening for interfacing with a second size fluid flow device;

the first and second fitment apparatuses having different size openings in the first and second protection assemblies for respectively interfacing with different size fluid flow devices for loading/unloading the shipping container; and interchangeably connecting the first fitment apparatus and the second fitment apparatus to the loading/unloading interface via the respective plurality of spring-loaded snaps based on selection of the first or second size fluid flow device.

5. The method according to claim 4, wherein the flange for the first fitment apparatus has an opening for forming a channel with the opening in the first projection assembly.

6. The method according to claim 4, wherein the flange for the second fitment apparatus has an opening for forming a channel with the opening in the second projection assembly.

* * * * *